US009560900B2

(12) United States Patent
Pier

(10) Patent No.: US 9,560,900 B2
(45) Date of Patent: Feb. 7, 2017

(54) ADJUSTABLE WATCH STRAP

(71) Applicant: Mauricio Pier, Beverly Hills, CA (US)

(72) Inventor: Mauricio Pier, Beverly Hills, CA (US)

( * ) Notice: Subject to any disclaimer, the term of this patent is extended or adjusted under 35 U.S.C. 154(b) by 113 days.

(21) Appl. No.: 14/312,161

(22) Filed: Jun. 23, 2014

(65) Prior Publication Data

US 2015/0366303 A1 Dec. 24, 2015

(51) Int. Cl.
*A44C 5/04* (2006.01)
*A44C 5/24* (2006.01)

(52) U.S. Cl.
CPC ..... *A44C 5/246* (2013.01); *Y10T 24/2155* (2015.01); *Y10T 24/4782* (2015.01)

(58) Field of Classification Search
CPC ..... Y10T 24/4782; Y10T 24/2166; Y10T 24/2155; A44C 5/246; A44C 5/04; A44C 5/2076; A44D 2211/02
See application file for complete search history.

(56) References Cited

U.S. PATENT DOCUMENTS 2,097,055 A * 10/1937 Bender ..... A44C 5/24 24/71 J
RE20,677 E 3/1938 Eklund
2,262,623 A 11/1941 Ritter
2,457,200 A * 12/1948 Bikoff ..... A44C 5/246 24/71 J
2,495,667 A 1/1950 Vizner
7,289,310 B1 10/2007 Yuan
2013/0286797 A1* 10/2013 Leger ..... A44C 5/246 368/282

FOREIGN PATENT DOCUMENTS

EP 2452583 A1 5/2012

OTHER PUBLICATIONS

International Search Report and Written Opinion dated Sep. 8, 2015 issued in International Application No. PCT/US2015/037197.

* cited by examiner

*Primary Examiner* — Robert J Sandy
*Assistant Examiner* — Michael Lee
(74) *Attorney, Agent, or Firm* — Tutunjian & Bitetto, P.C.

(57) ABSTRACT

An adjustable watch strap having a micro-adjustment system for providing micro adjustments to the circumferential length of the watch strap, in addition to existing standard adjustments. The micro adjustment system is integrated into a buckle (e.g., deployment buckle) and is configured to provide a plurality of microadjustments between standard adjustments or beyond a last or first standard adjustment.

20 Claims, 8 Drawing Sheets

ADJUSTABLE WATCH STRAP

BACKGROUND

1. Technical Field

The present principles generally relates to adjustable watch straps, more particularly, it relates to an adjustable watch strap having the capability of providing micro adjustments between standard adjustments.

2. Description of Related Art

Watches are popular accessories that traditionally provide the time of day and may provide additional data such as the date, a stop watch, etc. A watch strap which supports the watch preferably fits snugly enough on a user's wrist to resist rotation due to normal hand movements but without the strap being overly tight so as to provide excessive pressure and discomfort to the user.

Metal watch straps and non-metal watch straps are the two main types of watch straps known in the art. The non-metal watch straps may be fabricated out of materials such as leather, plastic or a variety of other materials. The adjustment of metal watch straps is accomplished by adding or removing links to the bracelet portion in order to change the circumferential length of the bracelet.

For non-metal watch straps, the straps typically have a fixed length and the circumferential length that the straps encircle the user's wrist is adjusted by securing the strap to a buckle at different holes on the strap. Tang buckles and deployment buckles are two main types of buckles that are used on non-metal straps in order to connect the straps and secure them on the user's wrist. Tang buckles secure the circumferential length of the strap by including a hook on the buckle which extends into a hole on a strap portion similar to the operation of a traditional belt. Deployment buckles for non-metal straps may also include a buckle head having a hook for extending through holes on a strap portion. However, deployment buckles also contain a plurality of metal strips which when opened, enlarge the circumference of the bracelet and allow for easy removal of the watch. The deployment buckle also protects the watch from being accidentally dropped upon removal because the straps remain connected to the buckle when the buckle is deployed.

A disadvantage of traditional deployment buckles is that the deployment buckle cannot be adjusted easily on the user's wrist once it is secured thereon. In order to adjust the circumferential length of the strap, the watch must be removed and the buckle must be fastened onto another hole on the strap. Sometimes the holes on traditional straps are spaced far apart and a user may not be able to obtain a proper fit with the provided holes. For example, the watch strap may initially not fit well with the provided holes on the watch strap. Alternatively, a watch strap that is initially fitted well on the user's wrist may become too loose or too tight based on environmental conditions or health conditions which affect the width of the user's wrist. In order to overcome this problem a user may have to add intermediary holes between two existing holes on the watch strap which is a difficult task and diminishes the attractiveness and structural integrity of the watch strap.

Watch straps have been made with numerous adjustment mechanisms in order to change the circumferential length of the strap around the user's wrist. However, all adjustable straps have adjustment increments, such as the standard spacing for the holes on a strap, which are unable to provide small or micro changes in the circumferential length of the strap between the provided hole adjustments in the band in order to provide an optimal fit for the user. Non-metal watch straps normally are adjustable by changing the hole that the strap is affixed to the buckle. However, the circumferential length of the watch strap cannot be adjusted solely at the buckle without changing the hole that the watch strap is secured to the buckle.

Accordingly, it is an aspect of the invention to provide a watch strap that provides microadjustments at the buckle in order to make small or micro adjustments to the circumferential length of the watch strap without changing the hole that the strap is affixed to the buckle.

It is another aspect of the invention to provide a watch strap having an adjustment mechanism which permits the user to easily adjust the circumferential length of the strap in small or micro increments without requiring special tools or skills.

It is a further aspect of the invention to provide a watch strap having an adjustment mechanism that is adjustable in small or micro increments and is cost effective to manufacture.

Yet a further aspect of the invention is an adjustable buckle mechanism that is configured to be incorporated into an existing buckle of a watch strap in order to allow the watch strap to be adjustable at the buckle in small or micro increments without changing the hole that the strap is affixed to the buckle.

SUMMARY OF THE INVENTION

The present principles include a micro adjustment system for an adjustable watch strap having first and second strap portions and standard adjustment increments. The micro adjustment system features a buckle attached to the first strap portion. The buckle includes a receiving slot on a first end and a spring. A micro-adjustment member is attached to the second strap portion.

The micro-adjustment member is configured to be slidably received within or retracted from the receiving slot of the buckle. The buckle includes releasable locking means fixedly securing a position of the micro-adjustment member within said receiving slot in one of a plurality of micro increments. The micro increments are smaller than the standard adjustment increments.

The adjustable watch strap of the present principles provides for micro adjustments between the standard watch strap adjustments to its circumferential length at the buckle, in order to provide a precise fit on the user's wrist. The adjustable watch strap is able to be easily adjusted by the user without requiring any special tools or skill. The adjustable watch strap allows the user to adjust the buckle in order to shorten or increase the circumferential length of the strap without changing the hole that the strap is affixed to the buckle. This provides for an optimal fit when the proper size for the user's wrist falls between two standard adjustment holes that the strap is affixed to the hook of the buckle. The spacing and number of apertures on the adjustment mechanism are dimensioned to provide specifically desired micro increments of adjustment between the ordinary adjustment increments, resulting in corresponding micro changes to the circumferential length of the watch strap.

BRIEF DESCRIPTION OF THE DRAWINGS

The features and advantages of the present invention will be more readily understood from a detailed description of the exemplary embodiments taken in conjunction with the following figures. Referring now to the drawings in which like numerals represent the same or similar elements.

DETAILED DESCRIPTION

Figure 1:
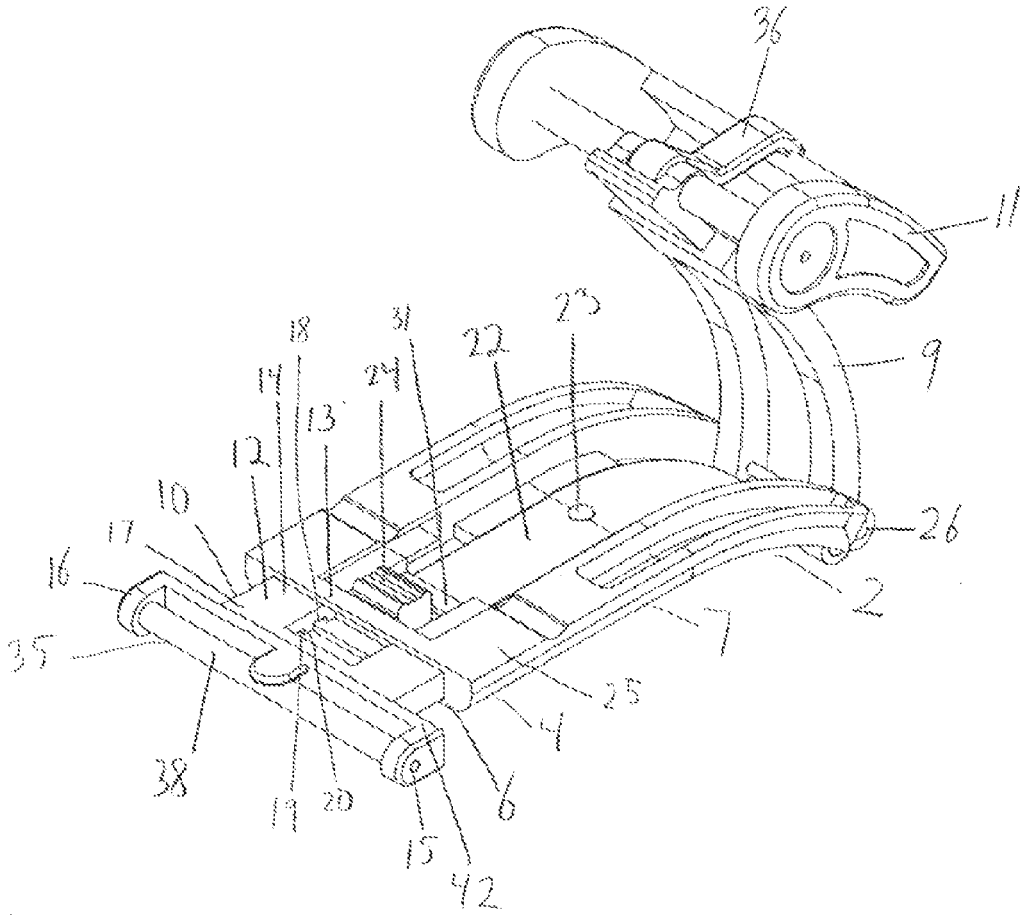
FIG. 1 shows a perspective view of the buckle and sliding adjustment member of the present invention.

In accordance with the present principles, an adjustable watch strap having the capability of providing micro adjustments to the circumferential length of the watch strap is provided which includes a buckle 2 having a buckle head 11 including a hook 36 which is attached to one of a plurality of holes on a first strap 32, a sliding adjustment member 10 attached to a second strap 34 and a watch case (not shown) which houses the watch element and is attached to the first and second straps. The watch strap is preferably fabricated out of a non-metal material. The buckle 2, first and second straps 32, 34 and the watch case housing the watch element form a watch assembly which encircles the wrist of the user. The sliding adjustment member 10 is configured to be slidably received within or retracted from a slot 6 on the buckle 2. The sliding adjustment member is configured to be secured in a plurality of predetermined positions that are configured to provide micro adjustments to the length that the watch assembly encircles the user's wrist without changing the hole that the strap is affixed to the hook 36 of the buckle.

Figure 4:
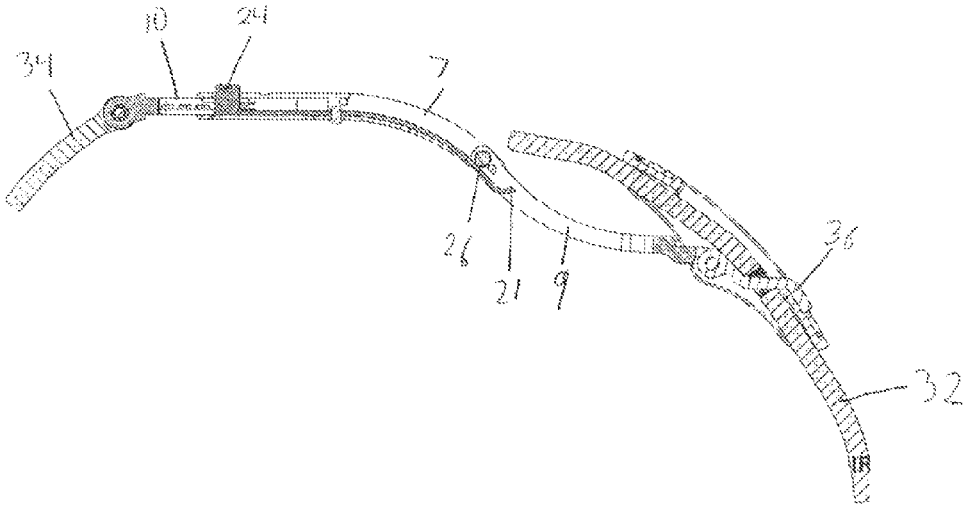
FIG. 4 shows a sectional view of the watch strap taken along line 1-1 of FIG. 3.
Figure 5:
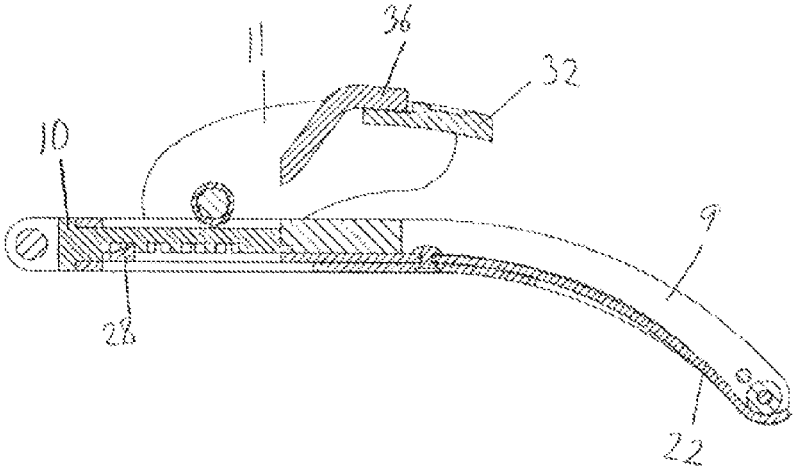
FIG. 5 shows a sectional view of the watch strap wherein the second strip of the buckle is positioned on top of the first strip of the buckle.

FIG. 1 shows the buckle 2 and sliding adjustment member 10 in accordance with the present principles. The buckle is a deployment buckle which includes a first strip 7 and a second strip 9 that are pivotably connected to each other at a hinge 26. The second strip 9 of the buckle shown in the FIGS. 1, 3, 4, 5 and 8-10 includes a buckle head 11 at its terminal end. The buckle head 11 is configured for releasably receiving the first strap 32 such as by a hook 36 which is received into one of a plurality of holes on the strap. As shown in FIG. 5, the second strip 9 may be pivoted to be positioned on top of the first strip 7 and may have securement means to maintain the buckle in this position.

Figure 7:
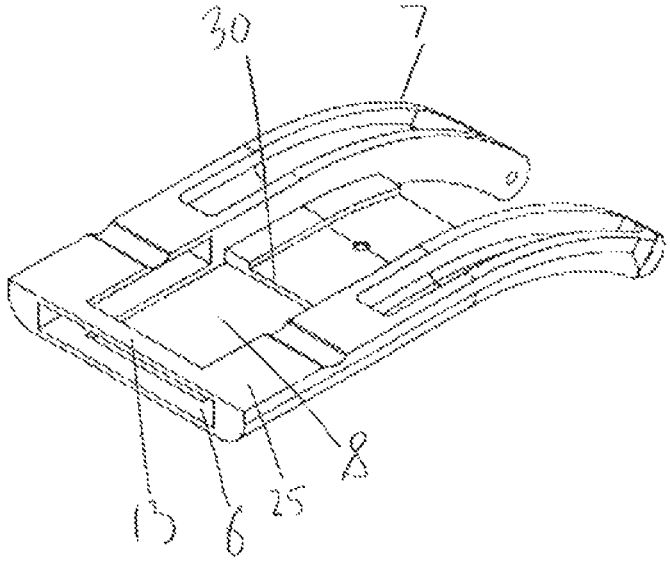
FIG. 7 shows a perspective view of the first strip of the buckle of the present invention.
Figure 8:
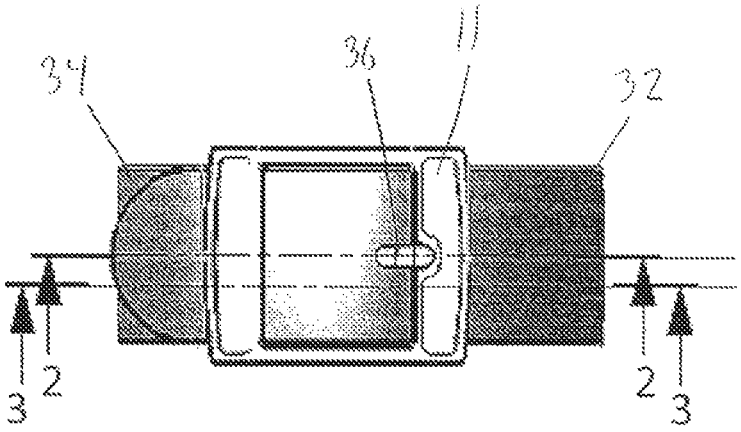
FIG. 8 shows a plan view of the watch strap of the present invention.

The first strip 7 of the buckle has a first end 4 having a receiving slot 6 on a perpendicular wall at its terminal portion of the first end 4. As shown in FIGS. 1 and 7, the top of the first end 4 is generally U-shaped and includes a narrow bar 13 at the terminal portion, side portions 25 and an opening 8 in the middle portion. As shown in FIGS. 1 and 7, the opening 8 in the middle portion is defined by the bar 13 at the terminal portion of the first end, the side portions 25 and a wall 30 on a lower surface of the first strip 7 which opposes the bar 13.

Figure 6:
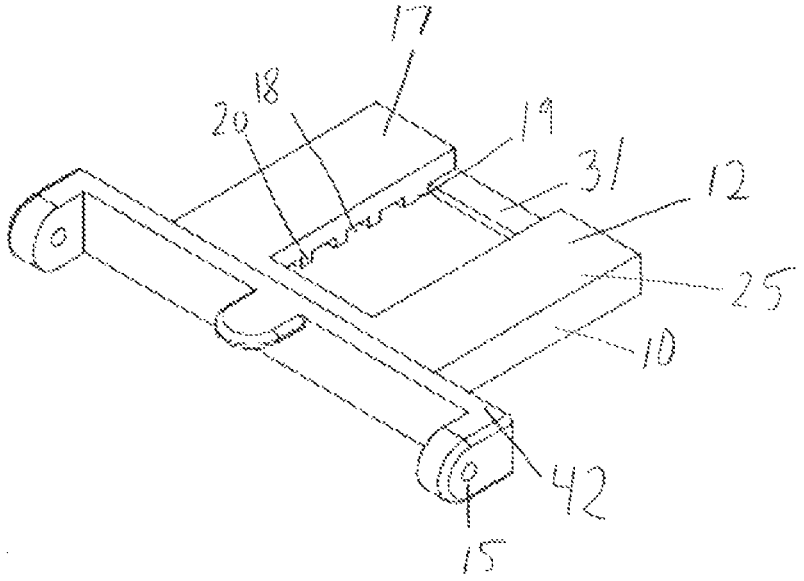
FIG. 6 shows a perspective view of the sliding adjustment member of the present invention.

As shown in FIGS. 1 and 6, the sliding adjustment member 10 includes a pair of laterally spaced arms 12 on a first end 14 and strap connecting means 16 on a second end 35. In the embodiment shown in FIG. 1 the strap connecting means 16 comprises a spring bar 38 that is received by two lugs 15 on opposed sides of the second end 35 of the sliding adjustment member. However, the strap connecting means of the sliding adjustment member 10 can be any other connection means known in the art. The laterally spaced arms 12 have relatively planar top surfaces 17 and a bottom surface 19 which includes a plurality of spaced teeth 20 extending downwardly and forming apertures 18 between the teeth 20.

Figure 2:
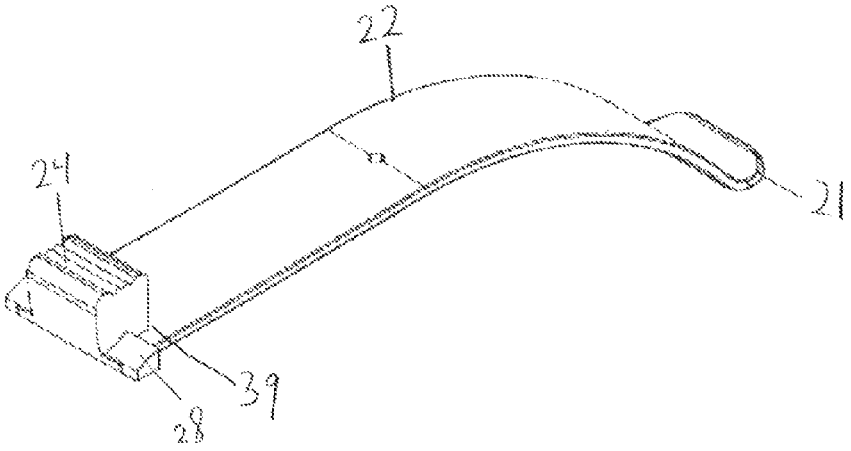
FIG. 2 shows a perspective view of the spring of the present invention.
Figure 3:
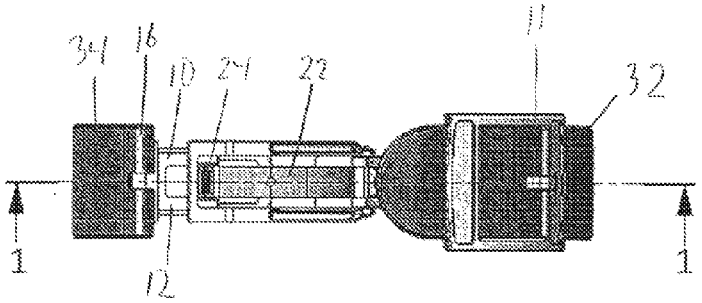
FIG. 3 shows a plan view of the watch strap wherein the sliding adjustment member is in a retracted position.

As shown in FIGS. 1 and 2, the first strip 7 of the buckle includes a spring 22 having a proximal end 39 which features an integral raised member or button 24 which is positioned adjacent the bar 13 at the top of the terminal portion of the first end 4 of the first strip 7. The spring 22 is arranged in the middle portion of the first strip 7 and follows the contours of the first strip. As shown in FIG. 4, the distal end 21 of the spring terminates past the hinge 26 between the first and second strips 7, 9 and the middle longitudinal region of the spring is secured to the first strip by a screw 23 or other releasable or permanent fastening means known in the art. The distal end 21 of the spring is preferably free so that it does not restrict movement of the first and second strips 7, 9 of the buckle.

Figure 10:
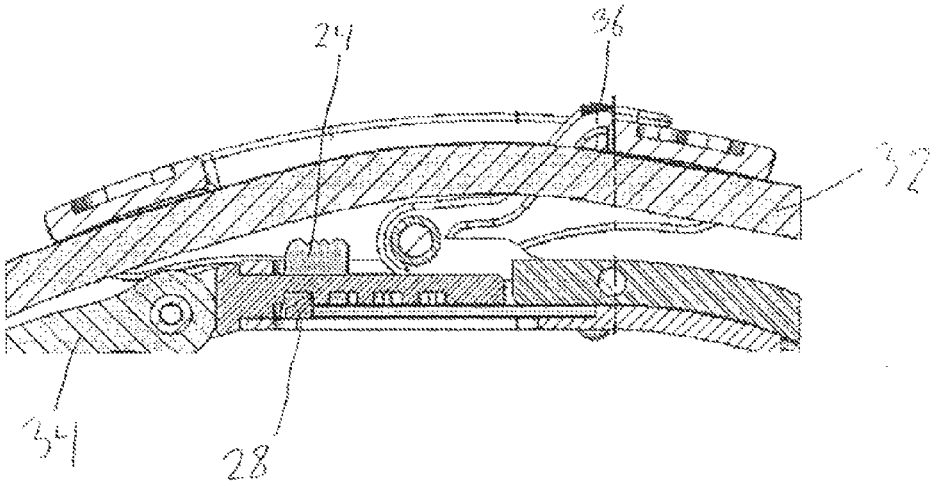
FIG. 10 shows a sectional view of the watch strap taken along line 3-3 of FIG. 8.

As shown in FIGS. 2, 5 and 10 the spring 22 includes raised side projections 28 on each side. While FIG. 2 shows two raised side projections 28, in other embodiments only a single side projection 28 may be used and still fall within the principles of the invention. The raised side projections 28 of the spring are dimensioned to fit within the apertures 18 of the sliding adjustment member in order to lock the position of the adjustment member 10 relative to the first strip 7 of the buckle.

In operation, the user can easily adjust the position of the sliding adjustment member 10 relative to the buckle 2 by pressing the button 24 with a finger or by other means in order to lower the spring and move the raised side projections 28 out of an aperture 18 on the adjustment member arms. While the button 24 remains depressed, the arms 12 of the sliding adjustment member may be slid into the slot 6 in order to shorten the circumferential length of the watch assembly at the buckle or they may be retracted from the slot in order to increase the circumferential length of the watch at the buckle. As shown in FIGS. 5 and 10, when the button 24 is released, the raised side projections 28 of the spring are biased upwards by the spring 22 and are received into an aperture 18 on the arms of the sliding adjustment member 10 in order to secure the position of the adjustment member. In order to eliminate movement of the sliding adjustment member 10 when the raised side projections 28 of the spring are within the apertures 18 of the arms of the adjustment member, it is preferred that the width of the raised side projections 28 are approximately the same as the width of the aperture. However, in alternative embodiments, the width of the raised side projections may be narrower than the apertures so that there is a degree of play when the sliding adjustment member is in a locked position. In the embodiment shown in FIG. 2, the top of the raised side projections 28 are angled downwardly toward the terminal portion of the first end. However, different configurations of the raised side projections may be used and still fall within the principles of the invention.

The spacing and number of apertures on the sliding adjustment member may be dimensioned to provide specific small or micro increments of adjustment and provide specific changes to the circumferential length of the watch strap. The micro adjustment increments are smaller than standard adjustment lengths in order to provide an optimal fit for the user. In a preferred embodiment, the slidable adjustment member may be slid into at least three different positions in order to change the circumferential length of the watch strap.

The adjustable buckle allows the user to easily adjust the watch at the buckle 2 in micro increments without adjusting the hole that the first strap 32 is affixed to the hook 36 of the buckle head 11 in order to provide an optimal fit for the user's wrist. The adjustable buckle provides the user with an optimal fit even when the width of the user's wrist is in between the sizes of two adjacent holes on the first strap portion 32. The micro-adjustments of the buckle allow quick and efficient adjustments to be made to the circumferential length of the watch strap in order to compensate for daily wrist size fluctuations due to environmental conditions, health conditions, etc. The micro-adjustments of the buckle also allow the circumferential length of the watch strap to be increased to a size greater than the largest standard adjustment size or decreased to a size that is less than the smallest standard adjustment size.

Figure 9:
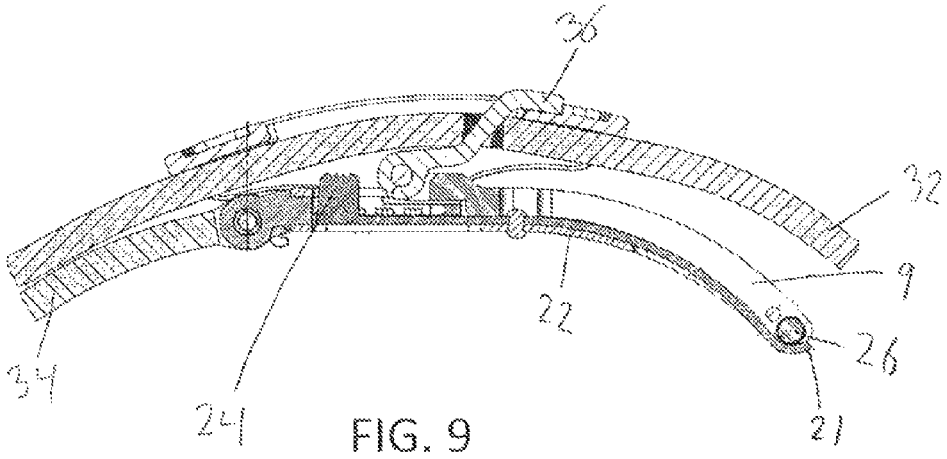
FIG. 9 shows a sectional view of the watch strap taken along line 2-2 of FIG. 8.

For instance, in FIG. 4, the sliding adjustment member 10 is fully retracted from the slot 6 on the buckle. In FIGS. 5, 9 and 10 the sliding adjustment member 10 is fully received within the slot 6 on the buckle. The length of the sliding adjustment member arms 12 may also be dimensioned to provide a specific overall possible length of adjustment as may be desired.

As shown in FIGS. 1 and 6, a second bar 31 limits the distance that the sliding adjustment member 10 can be retracted as the button 24 will contact the second bar 31 and prevent further retraction. Similarly, the sliding adjustment member 10 has a portion of its body which has a length and/or width that is greater than the corresponding dimension of the slot 6. In the embodiment shown in FIGS. 1 and 6, this portion of the adjustment body comprises a bar 42 on the sliding adjustment member immediately adjacent the arms which has a greater length and width than the slot. Therefore, the portion of the sliding adjustment member body having a greater length and/or width than the slot contacts the bar 13 at the terminal portion of the first end 4 of the first strip and serves to restrict further receiving of the second end of the sliding adjustment member 10 into the receiving slot 6.

While a deployable or deployment buckle configuration is specifically shown in the figures which uses non-metal strap portions, other strap configurations may be utilized, such as metal bracelet straps having connected first and second straps, or other straps known in the art, and still fall within the principles of the present invention.

The adjustable buckle may also be configured to be incorporated into a conventional tang buckle or other conventional buckles in order to provide the improved adjustment capabilities of the present invention.

The connection means for attaching the buckle to the straps may be, for example, spring bars that are received by two lugs, or may be any other connection elements known in the art and are not limited to those specifically shown in the figures.

While the application focuses on use of the buckle and sliding adjustment member with respect to watches, the principles disclosed herein may be used with respect to other adjustable encircling objects in numerous different fields.

It should be understood, of course, that the specific form of the invention herein illustrated and described is intended to be representative only, as certain changes may be made therein without departing from the clear teachings of the disclosure.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A micro adjustment system for an adjustable watch strap having first and second strap portions and standard adjustment increments, the micro adjustment system comprising;

a buckle attached to the first strap portion, said buckle including a receiving slot on a first end and a spring;

a micro-adjustment member attached to the second strap portion;

wherein said micro-adjustment member is configured to be slidably received within or retracted from the receiving slot of the buckle; and said buckle further comprising releasable locking means fixedly securing a position of the micro-adjustment member within said receiving slot in one of a plurality of micro increments, said micro increments being smaller than the standard adjustment increments.

2. The micro adjustment system of claim 1, wherein said releasable locking means comprises;

at least one raised projection on said spring dimensioned to fit within a plurality of apertures on the micro-adjustment member;

wherein a secured position of the micro-adjustment member is released by depressing the spring to release the at least one raised projection from a first aperture and, after changing the position of the adjustment member within the receiving slot, the position of the micro-adjustment member is secured by releasing the spring, such that the at least one raised projection is biased upwards into a second aperture by the spring.

3. The micro adjustment system of claim 1, wherein said micro-adjustment member comprises a pair of laterally spaced arms on a first end and strap connecting means on a second end, said laterally spaced arms being dimensioned to be received within the receiving slot of the buckle.

4. The micro adjustment system of claim 3, wherein the laterally spaced arms comprise relatively planar top surfaces and a bottom surface having a plurality of spaced teeth extending downward forming apertures between the teeth.

5. The micro adjustment system of claim 2, wherein the spring comprises a raised button configured to release the secured position of the micro-adjustment member when depressed.

6. The micro adjustment system of claim 5, wherein the raised button is positioned proximal the first end of the buckle.

7. The micro adjustment system of claim 3 wherein:

the spring comprises a raised button configured to release a secured position of the micro-adjustment member when the button is depressed; and the micro-adjustment member comprises a bar secured to the distal portion of the laterally spaced arms which contacts the button of the spring when the micro-adjustment member is retracted a first length in order to limit the distance that the micro-adjustment member can be retracted.

8. The micro adjustment system of claim 1 wherein the micro-adjustment member has a first portion that is wider than a width of the slot so that the first portion restricts further receiving of the micro-adjustment member into the slot.

9. The micro adjustment system of claim 8 wherein the first portion of the micro-adjustment member comprises a bar immediately adjacent the arms of the micro-adjustment member.

10. The micro adjustment system of claim 2 wherein the micro-adjustment member further comprises at least three apertures to provide at least three different possible micro increment adjustments of the adjustable watch strap.

11. The micro adjustment system of claim 1 wherein the buckle further comprises first and second strip members which are pivotably connected to each other.

12. The micro adjustment system of claim 11 wherein the receiving slot is positioned on the first strip of the buckle.

13. A micro adjustment system for an adjustable watch strap having first and second strap portions together forming a circumferential length of the watch strap, the watch strap having standard adjustment increments, the micro adjustment system comprising;

a buckle having first and second strip members which are pivotably connected to each other;

a receiving slot positioned on a first end of the first strip of the buckle;

a spring including a raised button on said first strip of the buckle; and a micro-adjustment member attached to the second strap portion, said adjustment member having laterally spaced arms having relatively planar top surfaces and a bottom surface having a plurality of spaced teeth extending downward forming apertures between the teeth;

said spring having at least one raised projection dimensioned to fit within said a plurality of apertures on said bottom surface of the laterally spaced arms of the adjustment member, said plurality of apertures being configured to provide a plurality of micro adjustment increments between the standard adjustment increments of the watch strap;

wherein a position of the micro-adjustment member relative to the first strip of the buckle is secured by the spring biasing the at least one raised projection upwards into one of said plurality of apertures on the bottom surface of the laterally spaced arms of the adjustment member;

wherein the micro-adjustment member is released from a secured position by depressing the raised button to remove the at least one raised projection from a first aperture.

14. The micro adjustment system of claim 13 wherein the micro adjustment member further comprises a bar secured to the distal portion of the laterally spaced arms configured to contact the button of the spring when the micro adjustment member is retracted a first length in order to limit the distance that the micro adjustment member can be retracted.

15. The micro adjustment system of claim 13 wherein the micro adjustment member body has a first portion that is wider than a width of the slot so that the first portion restricts further receiving of the adjustment member into the slot.

16. The micro adjustment system of claim 15 wherein the first portion of the adjustment member body comprises a bar on the adjustment member immediately adjacent the arms.

17. The micro adjustment system of claim 13 wherein the adjustment member further comprises at least three apertures providing at least three different possible micro adjustment increments of the adjustable watch strap.

18. A buckle providing micro adjustments for an adjustable watch strap having first and second strap portions and standard adjustment increments, comprising:

a first end of the buckle having a receiving slot;

a second end of the buckle attached to the first strap portion;

a spring;

a micro-adjustment member attached to the second strap portion, said micro-adjustment member configured to be slidably received within or retracted from the receiving slot; and releasable locking means fixedly securing the position of the micro-adjustment member within said receiving slot in one of a plurality of micro increments, said micro increments being smaller than the standard adjustment increments.

19. The buckle of claim 18, wherein said releasable locking means comprises:

at least one raised projection on said spring dimensioned to fit within a plurality of apertures on the micro-adjustment member;

wherein a secured position of the micro-adjustment member is released by depressing the spring to release the at least one raised projection from a first aperture and, after changing the position of the adjustment member within the receiving slot, the position of the micro-adjustment member is secured by releasing the spring, such that the at least one raised projection is biased upwards into a second aperture by the spring.

20. The buckle of claim 18, wherein:

said micro-adjustment member comprises a pair of laterally spaced arms on a first end and strap connecting means on a second end, said laterally spaced arms being dimensioned to be received within the receiving slot; and the laterally spaced arms comprise relatively planar top surfaces and a bottom surface having a plurality of spaced teeth extending downward forming apertures between the teeth.

* * * * *